US008033644B2

(12) United States Patent
Umeda

(10) Patent No.: US 8,033,644 B2
(45) Date of Patent: Oct. 11, 2011

(54) NOZZLE PROTECTOR FOR LIQUID DROPLET EJECTING APPARATUS

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 475 days.

(21) Appl. No.: 12/179,557

(22) Filed: Jul. 24, 2008

(65) Prior Publication Data

US 2009/0027451 A1 Jan. 29, 2009

(30) Foreign Application Priority Data

Jul. 24, 2007 (JP) ..... 2007-192032
Jul. 24, 2007 (JP) ..... 2007-192033

(51) Int. Cl.
*B41J 2/14* (2006.01)
*B41J 2/16* (2006.01)

(52) U.S. Cl. ..... 347/47; 347/68

(58) Field of Classification Search ..... 347/20, 347/44, 47, 22, 23, 29, 32, 33, 54, 68, 71
See application file for complete search history.

(56) References Cited

U.S. PATENT DOCUMENTS 6,299,288 B1 * 10/2001 Abeywardane et al. ..... 347/68

FOREIGN PATENT DOCUMENTS

JP 2003072041 A 3/2003

* cited by examiner

*Primary Examiner* — Juanita D Stephens
(74) *Attorney, Agent, or Firm* — Baker Botts L.L.P.

(57) ABSTRACT

A liquid droplet ejecting apparatus which ejects liquid to a recording medium, comprises a liquid droplet ejecting head including a nozzle surface in which a plurality of nozzles are formed, the nozzles being configured to eject liquid droplets; a dielectric elastomer disposed around the nozzle surface; a pair of electrodes configured to sandwich the dielectric elastomer; and a nozzle protector formed integrally with the dielectric elastomer on a recording medium side of the dielectric elastomer.

13 Claims, 11 Drawing Sheets

NOZZLE PROTECTOR FOR LIQUID DROPLET EJECTING APPARATUS

CROSS REFERENCE TO RELATED APPLICATION

This application claims priority to and the benefit of Japanese Patent Application No. 2007-192033, filed Jul. 24, 2007, and Japanese Patent Application No. 2007-192032, filed Jul. 24, 2007, the entire disclosures of which are incorporated herein by reference.

BACKGROUND OF THE INVENTION

1. Field of the Invention

The present invention relates to a liquid droplet ejecting apparatus, such as an ink jet printer, which ejects liquid to a recording medium.

2. Description of Related Art

An ink jet printer needs to eject ink from nozzles of an ink jet head onto target pixels on a sheet. Therefore, a nozzle surface of the ink jet head is located close to the sheet. On this account, if the sheet moving in a printing area bends, it may contact the nozzle surface of the ink jet head. If the sheet contacts the nozzle surface, the nozzle surface is rubbed to be worn away, and the sheet gets dirty. To solve this problem, a cover member may be disposed around the nozzle surface of the ink jet head. The cover member is disposed to project beyond the nozzle surface toward the sheet, and is formed so as not to block the orbit of the ink ejected from the nozzles (see Japanese Laid-Open Patent Application Publication 2003-72041 for example).

The cover member is required not to obstruct a wiping operation of wiping excess ink and stains from the nozzle surface. Therefore, the cover member can move up and down by an electric-powered cylinder. To be specific, when the wiping operation starts, the cover member is caused to move up by the electric-powered cylinder while being guided by a guide rail of a base. Thus, the cover member moves away from the sheet to be located more distant from the sheet than the nozzle surface.

However, since the cover member is driven by the electric-powered cylinder, the entire apparatus increases in size. In addition, it is difficult to precisely control the distance from the cover member to the sheet by the electric-powered cylinder.

SUMMARY OF THE INVENTION

An object of the present invention is to realize precise control of the position of a nozzle protector without increasing the size of the apparatus.

A liquid droplet ejecting apparatus of the present invention, which ejects liquid to a recording medium, includes: a liquid droplet ejecting head including a nozzle surface in which a plurality of nozzles are formed, the nozzles being configured to eject liquid droplets; a dielectric elastomer disposed around the nozzle surface; a pair of electrodes configured to sandwich the dielectric elastomer; and a nozzle protector formed integrally with the dielectric elastomer on a recording medium side of the dielectric elastomer.

In accordance with this configuration, when an electric field is generated by applying the voltage between the pair of electrodes, the dielectric elastomer contracts in an electric field direction, thereby changing the position of the nozzle protector. Even if the volume of the dielectric elastomer is small, the dielectric elastomer can deform greatly. Therefore, it is possible to significantly suppress the increase in size of the apparatus. Moreover, since the dielectric elastomer precisely changes its deformation amount in accordance with the value of the voltage applied between the electrodes, the position of the nozzle protector connected to the dielectric elastomer can also be controlled precisely. The dielectric elastomer may be attached to a member (such as a reinforcing frame, a carriage or a base) formed integrally with the liquid droplet ejecting head or may be attached to the liquid droplet ejecting head itself. Moreover, the nozzle protector may be attached to a member formed integrally with the dielectric elastomer of may be attached to the dielectric elastomer itself.

A direction in which the pair of electrodes sandwich the dielectric elastomer may substantially conform to a normal direction of the nozzle surface.

In accordance with this configuration, since the dielectric elastomer contracts in the normal direction of the nozzle surface, it is possible to easily change the distance of the nozzle protector from the nozzle surface.

The nozzle protector may be attached indirectly to a surface of the dielectric elastomer which is orthogonal to a direction in which the dielectric elastomer mainly contracts.

In accordance with this configuration, the amount of displacement of the nozzle protector can be increased.

The dielectric elastomer may be disposed such that a main surface thereof is opposed to the nozzle protector, one of the pair of electrodes may be formed on a surface of the dielectric elastomer which surface is located on a side of the nozzle protector, and the other one of the pair of electrodes may be formed on a surface of the dielectric elastomer which surface is located on a side opposite the side of the nozzle protector.

In accordance with this configuration, since a main surface that is a largest flat surface of the dielectric elastomer is opposed to the nozzle protector, and the electrode is stacked on the main surface, it is possible to stabilize displacement accuracy of the nozzle protector.

The liquid droplet ejecting head may include: a passage unit having the nozzle surface, and a plurality of liquid chambers which are respectively disposed to communicate with the plurality of nozzles; and an actuator having a plurality of driving portions configured to independently change volumes of the plurality of liquid chambers. A reinforcing frame may be attached to a surface of the passage unit opposite the nozzle surface so as to project from the surface of the passage unit; and the nozzle protector may be disposed such that the dielectric elastomer is sandwiched between the nozzle protector and a portion of the reinforcing frame which portion projects from the surface of the passage unit.

In accordance with this configuration, the dielectric elastomer can be disposed by effectively utilizing a space on a side of the passage unit.

The liquid droplet ejecting apparatus may further include: a voltage generator configured to apply a voltage between the pair of electrodes; and a controller configured to control the voltage generator.

In accordance with this configuration, the dielectric elastomer can be suitably automatically controlled.

The controller may be configured to control the voltage generator such that the nozzle protector moves between a projecting position in which the nozzle protector projects beyond the nozzle surface toward the recording medium and a non-projecting position in which the nozzle protector does not project beyond the nozzle surface toward the recording medium. The non-projecting position includes a position in a case where a surface of the nozzle protector which surface is located on a side of the recording medium is flush with the nozzle surface, and a position in a case where the surface of the nozzle protector which surface is located on the side of the recording medium moves away from the recording medium to be located more distant from the recording medium than the nozzle surface.

In accordance with this configuration, it is possible to easily adjust a priority balance between a nozzle protecting function of causing the nozzle protector to project so as not to cause the recording medium to contact the nozzle surface, and an ejecting accuracy improving function of decreasing the amount of projection of the nozzle protector so as to cause the nozzle surface and the recording medium to get close to each other.

In a state where a voltage is not applied between the pair of electrodes, the nozzle protector may be located at the projecting position, and when the voltage is applied between the pair of electrodes, the dielectric elastomer may contract in a normal direction of the nozzle surface, and the nozzle protector may move to the non-projecting position.

In accordance with this configuration, since the nozzle protector usually projects due to its functions, it is set to project in a state where the voltage is not applied between the electrodes. With this, a time during which the voltage is applied can be reduced, and thereby the power consumption can be suppressed.

The liquid droplet ejecting apparatus may further include a wiping device configured to carry out an operation of wiping the nozzle surface, wherein the controller may control the voltage generator such that the voltage is applied between the pair of electrodes during the operation of the wiping device.

In accordance with this configuration, the voltage may be applied in the wiping operation which is much less frequently carried out than printing. With this, the time during which the voltage is applied can be reduced significantly, and thereby the power consumption can be suppressed.

The voltage applied between the pair of electrodes during the operation of the wiping device may be a voltage causing the nozzle protector to move to the non-projecting position.

In accordance with this configuration, since the nozzle protector moves away from the recording medium to be located more distant from the recording medium than the nozzle surface, it is possible to easily wipe the nozzle surface.

The liquid droplet ejecting head may be an ink jet head, the recording medium may be a printing sheet, and the controller may control the voltage generator such that an amount of projection of the nozzle protector which projects beyond the nozzle surface toward the recording medium than is changed in accordance with a printing condition.

In accordance with this configuration, since the amount of projection of the nozzle protector from the nozzle surface can be changed in accordance with the printing condition, the amount of projection of the nozzle protector can be optimized in accordance with a printing state. To be specific, it is possible to adjust in accordance with the printing condition a priority balance between the nozzle protecting function of causing the nozzle protector to project so as not to cause the recording medium to contact the nozzle surface, and an image quality improving function of decreasing the amount of projection of the nozzle protector so as to cause the nozzle surface and the recording medium to get close to each other. Therefore, it is possible to suitably achieve both the protection of the nozzle surface and the improvement of the image quality. The printing condition is not limited to a condition input by a user, and may be a condition detected by, for example, a detecting device, and received by a control device.

The controller may control the voltage generator such that the amount of projection of the nozzle protector toward the recording medium decreases as the printing condition increases a degree of contribution to an improvement of image quality.

In accordance with this configuration, generally, the recording medium becomes less likely to contact the nozzle surface as the printing condition is associated with high image quality. Therefore, by decreasing the amount of projection of the nozzle protector, it is possible to suppress contact between the recording medium and the nozzle protector. On this account, it is possible to effectively decrease the gap between the nozzle surface and the recording medium.

The printing condition may include printing resolution information, and the controller may control the voltage generator such that the amount of projection of the nozzle protector decreases as a printing resolution of the printing resolution information increases.

In accordance with this configuration, the degree of abrasion of the recording medium with respect to the nozzle surface differs depending on the printing resolution. Therefore, by decreasing the amount of projection of the nozzle protector as the printing resolution increases, it is possible to effectively balance the prevention of abrasion and the improvement in printing accuracy.

The printing condition may include recording medium type information, and the controller may control the voltage generator such that the amount of projection of the nozzle protector decreases as flexibility of the recording medium of the recording medium type information decreases.

In accordance with this configuration, by increasing the amount of projection of the nozzle protector as the flexibility of the recording medium increases, it is possible to effectively prevent or reduce the contact between the recording medium and the nozzle surface.

The printing condition may include printing speed information, and the controller may control the voltage generator such that the amount of projection of the nozzle protector decreases as a printing speed of the printing speed information decreases.

In accordance with this configuration, the contact of the recording medium with respect to the nozzle surface decreases as the printing speed decreases as in high-quality image printing. Therefore, decreasing the amount of projection of the nozzle protector can contribute to the improvement of the image quality. Meanwhile, by increasing the amount of projection of the nozzle protector as the printing speed increases as in low-quality image printing, it is possible to effectively prevent or reduce the contact of the recording medium with respect to the nozzle surface. The printing speed includes a scanning speed of the head and a feeding speed of the recording medium.

The liquid droplet ejecting apparatus may further include: a gap adjusting mechanism configured to displace the ink jet head in a normal direction of the nozzle surface; and a gap controller configured to control the gap adjusting mechanism such that a gap between the nozzle surface and the recording medium decreases as the printing condition increases a degree of contribution to an improvement of image quality.

In accordance with this configuration, since the gap between the nozzle surface and the recording medium decreases at the time of the high-quality image printing, it is possible to effectively improve the ejecting accuracy of the ink, thereby improving the image quality.

The liquid droplet ejecting apparatus may further includes a flexible cable connected to the liquid droplet ejecting head, wherein the liquid droplet ejecting head may include a passage unit having a plurality of liquid chambers which are respectively disposed to communicate with the plurality of nozzles, and an actuator having a plurality of driving portions configured to independently change volumes of the plurality of liquid chambers, and the flexible cable may include a plurality of actuator driving wires connected to the plurality of driving portions of the actuator, and a dielectric elastomer driving wire connected to at least one of the pair of electrodes.

In accordance with this configuration, since the flexible cable connected to the ink jet head also functions as a wire member connected to the electrode of the dielectric elastomer, it is possible to reduce the number of components.

The nozzle protector may be attached to a surface of the dielectric elastomer, which is orthogonal to a direction in which the dielectric elastomer mainly contracts.

In accordance with this configuration, the amount of displacement of the nozzle protector can be increased.

The nozzle protector may be made of an electrically-conductive material, and the nozzle protector may function as one of the pair of electrodes.

In accordance with this configuration, since the nozzle protector made of the electrically-conductive material also functions as the electrode, it is possible to reduce the number of components.

BRIEF DESCRIPTION OF THE DRAWINGS

Embodiments of the invention now are described with reference to the accompanying drawings, which are given by way of example only, and are not intended to limit the present invention.

DETAILED DESCRIPTION OF PREFERRED EMBODIMENTS

Preferred embodiments of the present invention, and their features and advantages, may be understood by referring to accompanying drawings, like numerals being used for corresponding parts in the various drawings. In the following description, a direction in which an ink jet head ejects ink is referred to as "downward" or "below", and its opposite direction is referred to as "upward".

Embodiment 1

Figure 1:
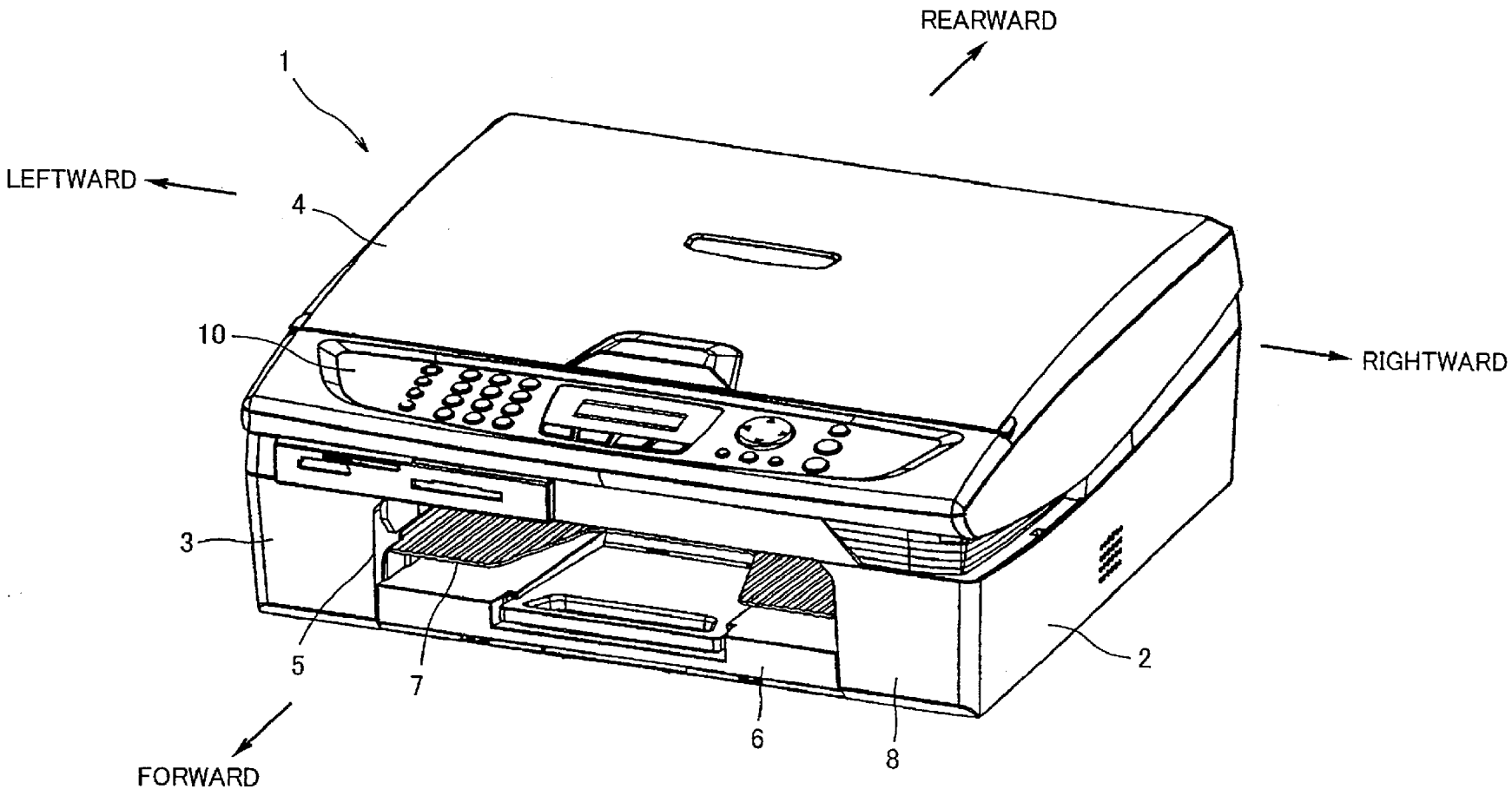
FIG. 1 is a perspective view showing a multifunction machine including an ink jet printer according to Embodiment 1 of the present invention.

As shown in FIG. 1, the multifunction machine 1, which is capable of printing, scanning, copying and facsimile transmission, may include a liquid droplet ejecting apparatus, e.g., an ink jet printer 3 at a lower portion of a casing 2, and a scanner 4 at an upper portion of the casing 2. An opening 5 is formed on a front surface of the casing 2. A sheet supply tray 6 of the ink jet printer 3 is provided at a lower position of the opening 5, and a sheet discharge tray 7 of the ink jet printer 3 is provided at an upper position of the opening 5. An openable lid 8 is provided at a front surface right lower portion of the ink jet printer 3. A cartridge mounting portion 26 (see FIG. 2) is provided inside the openable lid 8. An operation panel 10 is provided on a front surface side of an upper portion of the multifunction machine 1 to enable the ink jet printer 3, and the scanner 4 to be operated by a user. In addition, the multifunction machine 1 is operable in accordance with instructions supplied from external personal computers (not shown).

Figure 2:
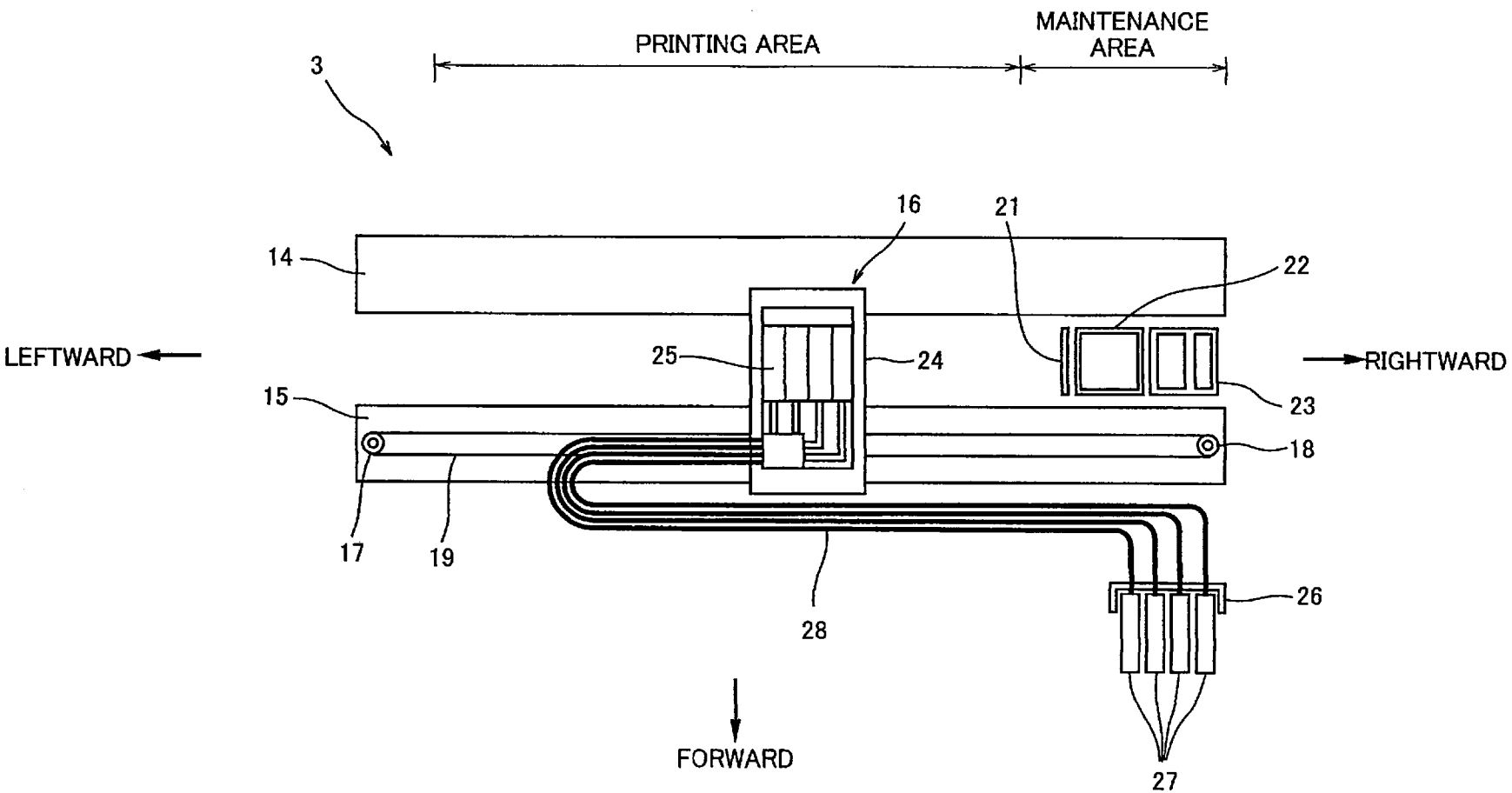
FIG. 2 is a schematic plan view of the ink jet printer shown in FIG. 1.

As shown in FIG. 2, the ink jet printer 3 includes a pair of guide rails 14 and 15 which are disposed substantially in parallel with each other, and an image recording unit 16 which is supported by the guide rails 14 and 15 so as to be slidable in a scanning direction. The image recording unit 16 is joined to a timing belt 19 which winds around a pair of pulleys 17 and 18. The timing belt 19 extends substantially in parallel with a direction in which the guide rail 15 extends. A motor (not shown), which rotates clockwise or counterclockwise, is attached to the pulley 18. The motor causes the pulley 18 to rotate clockwise or counterclockwise, thereby causing the timing belt 19 to reciprocate, which causes the image recording unit 16 to scan along the guide rails 14 and 15.

An area in which the image recording unit 16 reciprocates includes: a printing area in which an image is recorded on a printing sheet 30 (see FIG. 3) that is a recording medium; and a maintenance area in which the image is not recorded. In the maintenance area, a wiping device, e.g., a wiper blade 21, a waste ink receiver 22 and a suction cap 23 are disposed at a downward position between the guide rails 14 and 15. In the maintenance area, a wiping operation of wiping a nozzle surface 42*a* (see FIG. 3), i.e., a lower surface of the image recording unit 16 with the wiper blade 21, a purging operation of sealing the nozzle surface 42*a* (see FIG. 3) of the image recording unit 16 with the suction cap 23 and suctioning waste such as dry ink and foreign matters from nozzles 84 (see FIG. 4) under a negative pressure, and a flushing operation of ejecting the ink toward the waste ink receiver 22 regardless of image data are carried out.

The image recording unit 16 includes a carriage 24 that is a casing. The carriage 24 includes four buffer tanks 25 which temporality store the ink. The cartridge mounting portion 26 is provided on a right front side of the guide rail 15. Four-color (black, cyan, magenta and yellow) ink cartridges 27 are detachably attached to the cartridge mounting portion 26. The ink cartridges 27 attached to the cartridge mounting portion 26 are connected to the buffer tanks 25, respectively, via ink supply tubes 28.

Figure 3:
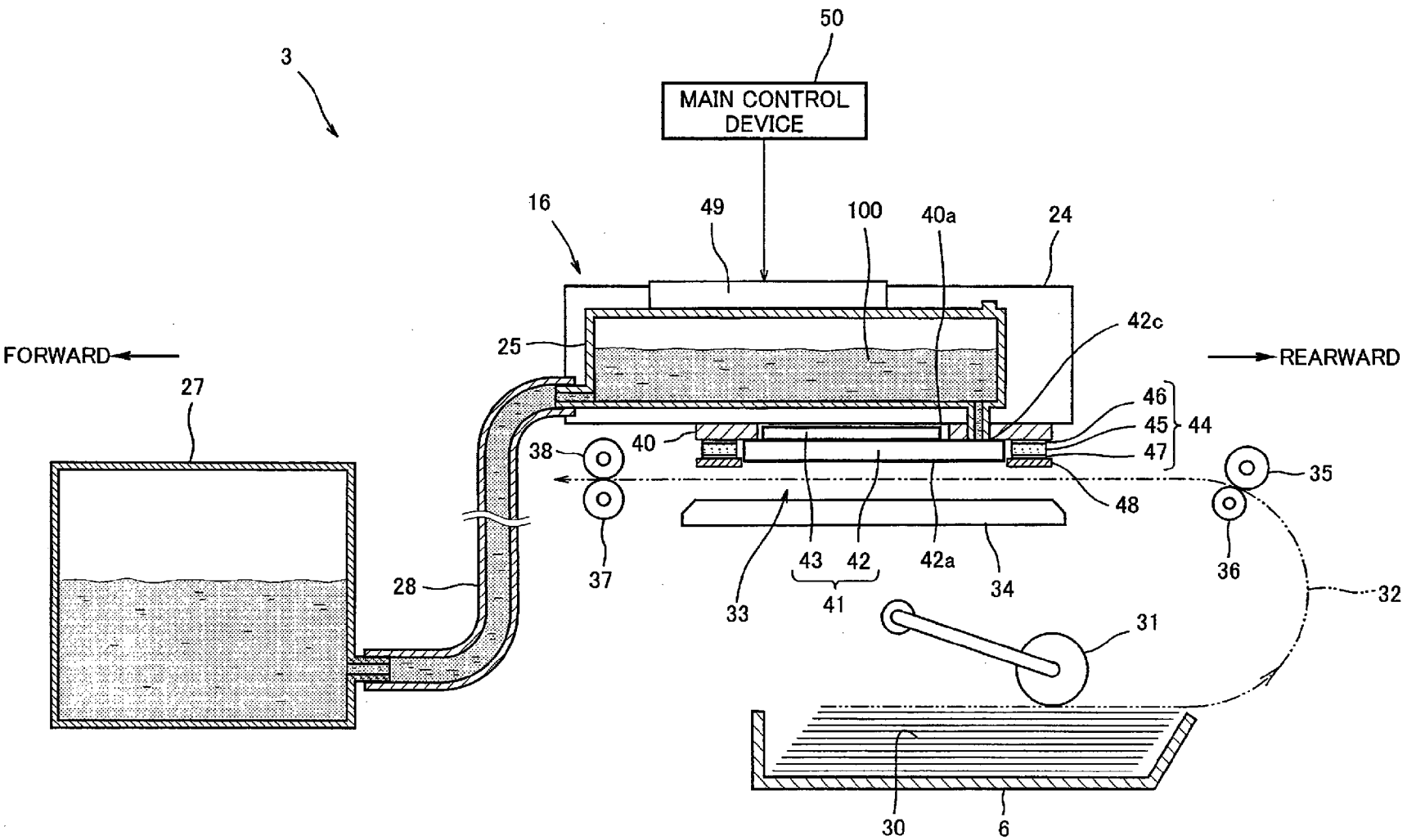
FIG. 3 is a partially schematic cross-sectional view of the ink jet printer shown in FIG. 1.

As shown in FIG. 3, the sheet supply tray 6 is provided at a bottom portion of the ink jet printer 3. On an upper side of the sheet supply tray 6, a sheet supply drive roller 31 is disposed, which supplies to a feed path 32 an uppermost sheet of the printing sheets 30 disposed on the sheet supply tray 6. The feed path 32 extends upwardly from a rear side of the sheet supply tray 6, makes a U-turn toward the front side, passes through a printing area 33, and reaches the sheet discharge tray 7 (see FIG. 1).

A platen 34 is disposed below the image recording unit 16. A feed roller 35 and a pinch roller 36 are provided upstream from the image recording unit 16 in a direction where a sheet is fed (hereinafter referred to as a sheet feeding direction). The feed roller 35 and the pinch roller 36 are configured to sandwich therebetween the printing sheet 30 being fed through the feed path 32 and to feed the printing sheet 30 onto the platen 34. A sheet discharge roller 37 and a pinch roller 38 are provided downstream of the image recording unit 16 in the sheet feeding direction. The sheet discharge roller 37 and the pinch roller 38 are configured to sandwich therebetween the printed printing sheet 30 and to feed the printed printing sheet 30 onto the sheet discharge tray 7 (see FIG. 1).

An ink jet head 41 (liquid droplet ejecting head) is attached to a lower portion of the carriage 24 via a frame-plate-shaped reinforcing frame 40 having a central opening 40*a*. Note that the reinforcing frame 40 may have any shape as long as it does not block the orbit of the ink ejected from the nozzles 84.

The ink jet head 41 includes: a passage unit 42 having a plurality of liquid chambers 85 (see FIG. 7) which guide liquid, e.g., ink 100, supplied from the buffer tanks 25, from an inlet 42*c* to a large number of nozzles 84 (see FIG. 4); and a piezoelectric actuator 43 which is stacked on an upper surface of the passage unit 42 to selectively apply an ejecting pressure, directed to the nozzles 84 (see FIG. 4), to the ink in the passage unit 42. A peripheral portion of an upper surface of the passage unit 42 is fixed to a lower surface of the reinforcing frame 40, and the actuator 43 is disposed on the central opening 40*a* of the reinforcing frame 40. The reinforcing frame 40 is attached to the upper surface of the passage unit 42 so as to project outward therefrom.

A frame-shaped protector driving device 44 is bonded to a lower surface of the reinforcing frame 40 which projects from the passage unit 42. The protector driving device 44 includes: a frame-plate-shaped dielectric elastomer 45; a thin-film upper electrode 46 formed on an upper surface, i.e, a main surface of the dielectric elastomer 45; and a thin-film lower electrode 47 formed on a lower surface, i.e., a main surface of the dielectric elastomer 45. A frame-plate-shaped nozzle protector 48 is bonded to a lower surface of the protector driving device 44 which surface is located on the platen 34 side (that is, on the printing sheet side). To be specific, the dielectric elastomer 45 is disposed such that the upper surface thereof is attached to the reinforcing frame 40 via the upper electrode 46, and the lower surface thereof is attached to the nozzle protector 48 via the lower electrode 47. Therefore, the dielectric elastomer 45 is sandwiched between the projecting portion of the reinforcing frame 40 and the nozzle protector 48 via the electrodes 46 and 47 around the passage unit 42 (see FIGS. 3 and 4). A direction in which the dielectric elastomer 45 is sandwiched by the upper electrode 46 and the lower electrode 47 is a vertical direction, and substantially conforms to a normal direction of the nozzle surface 42*a*. A direction in which the dielectric elastomer 45 mainly contracts substantially conforms to the direction in which the electrodes 46 and 47 sandwich the dielectric elastomer 45.

Figure 5:
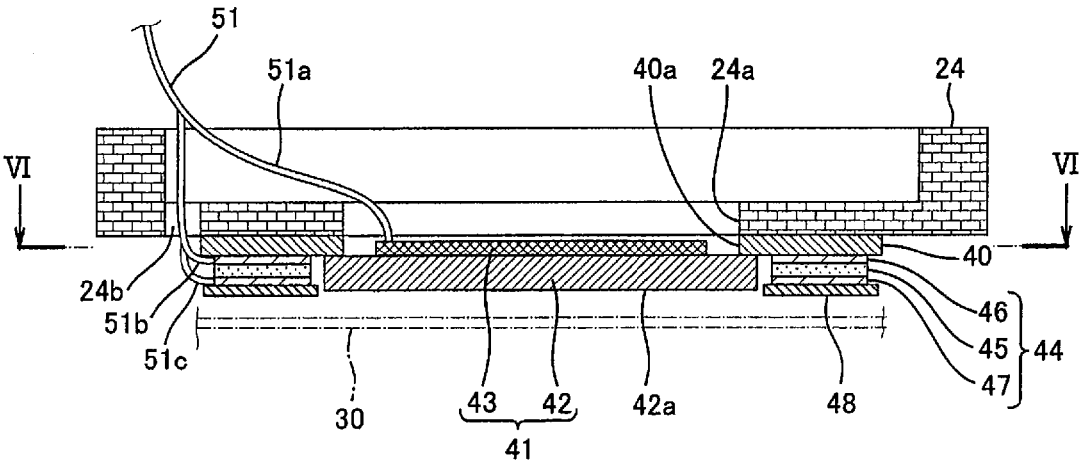
FIG. 5 is a cross-sectional view taken along line V-V of FIG. 4.

Further, the carriage 24 includes a head control device 49 which is connected to the ink jet head 41 via a flat flexible cable 51 (see FIG. 5). The head control device 49 is connected to a main control device 50.

Figure 4:
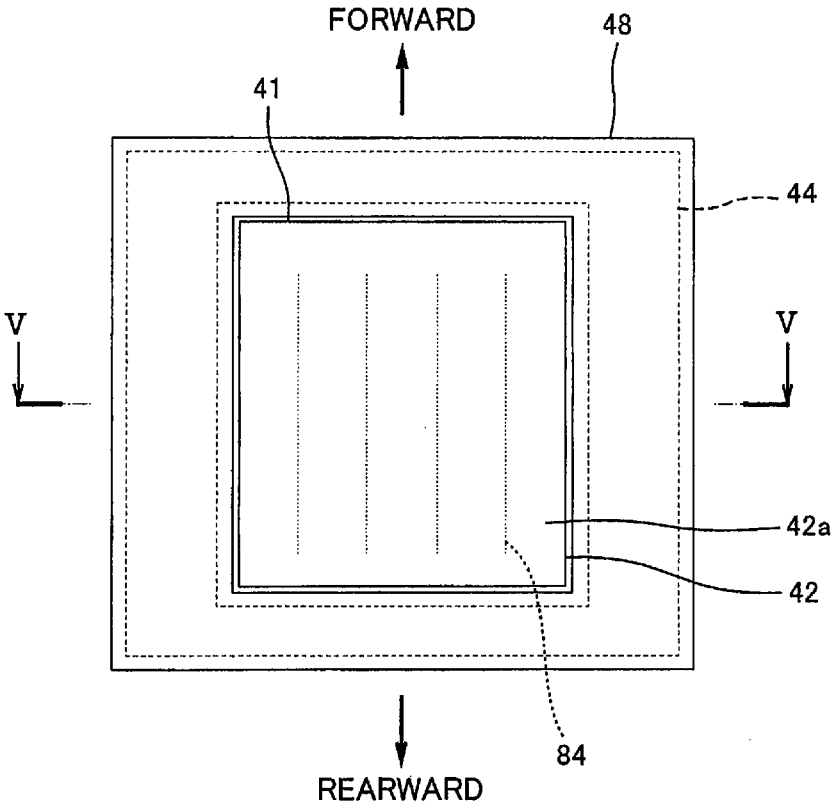
FIG. 4 is a bottom view of an ink jet head and its vicinity shown in FIG. 3 when viewed from below.
Figure 6:
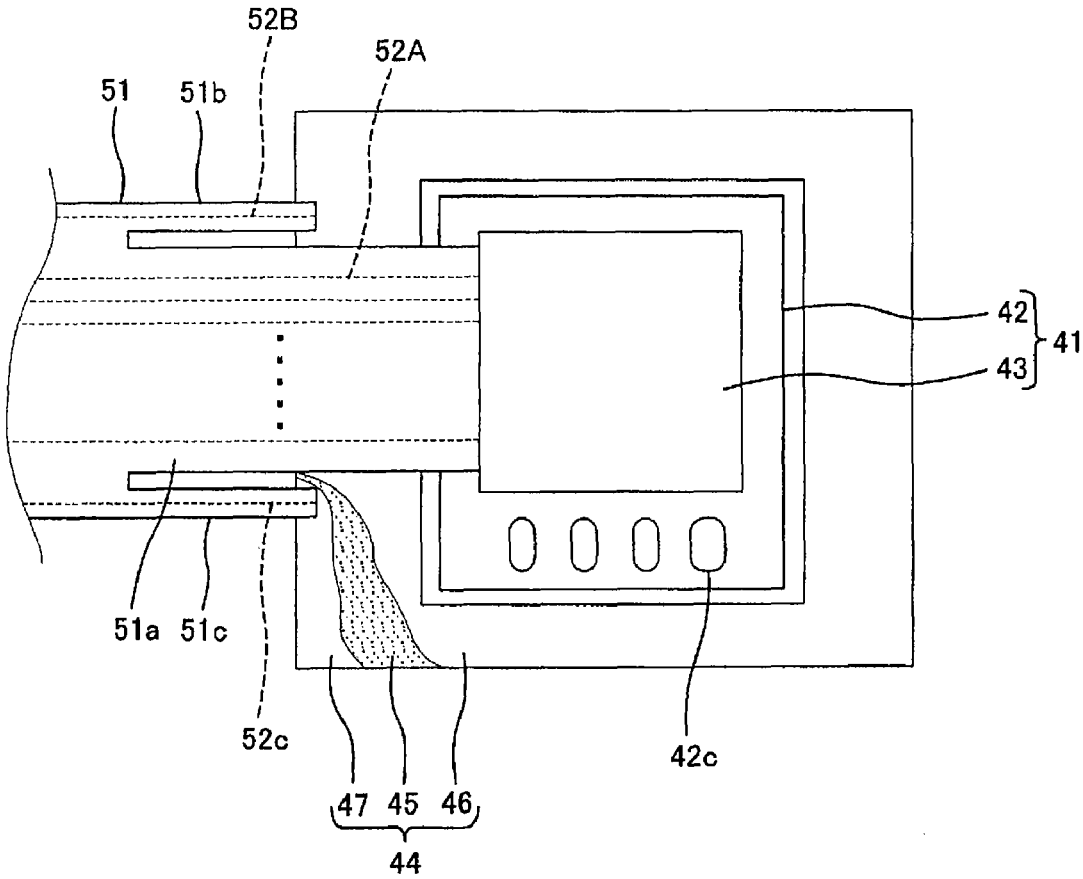
FIG. 6 is a cross-sectional view taken along line VI-VI of FIG. 5.

FIG. 4 is a diagram of the ink jet head 41 shown in FIG. 3 and its vicinity when viewed from below. FIG. 5 is a cross-sectional view taken along line V-V of FIG. 4. FIG. 6 is a cross-sectional view taken along line VI-VI of FIG. 5. In FIG. 5, the buffer tanks 25 and the head control device 49 are omitted. In FIG. 6, the reinforcing frame 40 is omitted, and the flexible cable 51 is illustrated as being developed. As shown in FIGS. 4 and 5, the protector driving device 44 is disposed to be spaced apart from an end portion of the passage unit 42 by a predetermined distance. This is because the dielectric elastomer 45 is prevented from contacting the passage unit 42 when a voltage is applied between the upper electrode 46 and the lower electrode 47 to generate an electric field in the vertical direction, and thereby the dielectric elastomer 45 contracts in an electric field direction (normal direction of the nozzle surface 42*a*) and expands in a direction (horizontal direction) orthogonal to the electric field direction. The dielectric elastomer 45 is made of, for example, silicone-based resin or acryl-based resin, and its thickness in the vertical direction is 0.6 to 0.8 mm. The upper electrode 46 and the lower electrode 47 are made of, for example, aluminum, copper or gold and formed by sputtering or CVD, and each thickness is 1 to 5 μm. A voltage of, for example, 1 to 2 kV is applied between the upper electrode 46 and the lower electrode 47 by a below-described voltage applying section 61 (see FIG. 8). A deformation ratio of the dielectric elastomer 45 in the thickness direction at the time of a maximum voltage is 50%.

Moreover, the nozzle protector 48 is disposed around the nozzle surface 42*a* of the ink jet head 41 in plan view so as to be spaced apart from the ink jet head 41 by a very short distance. The nozzle protector 48 projects, for example, 0.3 mm below the nozzle surface 42*a* in a state where the voltage is not applied between the upper electrode 46 and the lower electrode 47. When the voltage is applied between the upper electrode 46 and the lower electrode 47, the dielectric elastomer 45 contracts in the normal direction of the nozzle surface 42*a*, and thereby the nozzle protector 48 moves away from the platen 34 (printing sheet) side to a non-projecting position side in which the nozzle protector 48 does not project beyond the nozzle surface 42*a* toward the platen 34 (printing sheet).

As shown in FIGS. 5 and 6, the carriage 24 includes: a large opening 24*a* through which an internal space thereof is communicated with the central opening 40*a* of the reinforcing frame 40; and a small opening 24*b* which is opened toward an outer side end portion of the protector driving device 44. A tip end portion of the flexible cable 51 extending from the head control device 49 (see FIG. 3) branches into an actuator driving wire portion 51*a*, a dielectric elastomer driving wire portion 51*b* and a grounding wire portion 51*c*. The actuator driving wire portion 51*a* includes a plurality of driving conductors 52A which are connected to a plurality of driving portions of the actuator 43 to be supplied with necessary voltage. Moreover, the dielectric elastomer driving wire portion 51*b* includes a driving conductor 52B which is connected to the upper electrode 46 to be supplied with a necessary voltage. Further, the grounding wire portion 51*c* includes a grounding conductor 52C which is connected to the lower electrode 47 to be kept at a ground potential.

Moreover, the actuator driving wire portion 51*a* extends through the large opening 24*a* to be connected to the actuator 43 of the ink jet head 41. The dielectric elastomer driving wire portion 51*b* extends through the small opening 24*b* to be connected to the upper electrode 46 of the protector driving device 44. The grounding wire portion 51*c* extends through the small opening 24*b* to be connected to the lower electrode 47 of the protector driving device 44.

Figure 7:
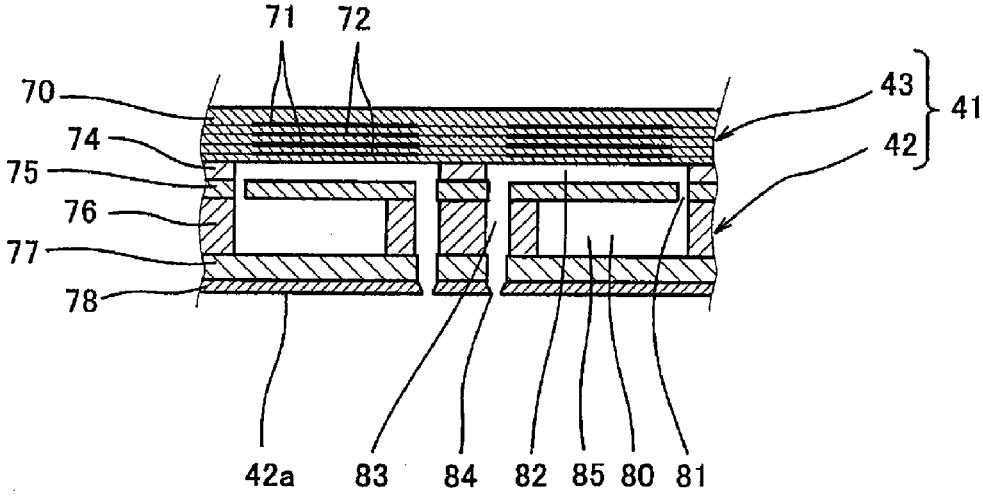
FIG. 7 is a cross-sectional view showing major components of the ink jet head shown in FIG. 3.

As shown in FIG. 7, the ink jet head 41 is formed by stacking and bonding the passage unit 42 and the actuator 43 each other, as described above. The passage unit 42 is formed by stacking and bonding a plurality of plates 74 to 78 having therein openings constituting an ink passage. The lowermost plate 78 is provided with a plurality of the nozzles 84 which open downwardly and are arranged in line. The uppermost plate 74 includes a plurality of pressure chambers 82 (liquid chambers) which are arranged in line so as to correspond to a plurality of the nozzles 84. An outflow passage 83 communicated with the nozzle 84 is formed at one end portion of the pressure chamber 82, and a connecting passage 81 communicated with a common liquid chamber 80 is formed at the other end portion of the pressure chamber 82. The common liquid chamber 80 is disposed for each ink color to extend in a line direction of the nozzles 84 which is orthogonal to the scanning direction, so as to overlap a plurality of the pressure chambers 82 in plan view. The common liquid chamber 80 is supplied with the ink from the buffer tank 25 (see FIG. 3) through the inlet 42*c* (see FIG. 6) which opens on the upper surface of the passage unit 42.

The actuator 43 is formed by stacking a plurality of sheet-shaped piezoelectric elements 70 made of, for example, PZT. The actuator 43 is disposed to cover the pressure chambers 82. Among the piezoelectric elements 70, each of even numbered piezoelectric elements 70 counted from bottom is provided on an upper surface thereof with individual electrodes 71 at positions corresponding to the pressure chambers 82. Moreover, each of odd numbered piezoelectric elements 70 counted from bottom is provided on an upper surface thereof with a common electrode 72 which corresponds to a plurality of the pressure chambers 82. To be specific, the individual electrode 71 and the common electrode 72 are disposed to sandwich therebetween one piezoelectric element 70 except for the lowermost and uppermost piezoelectric elements 70. An area sandwiched by the individual electrode 71 and the common electrode 72 is a driving portion. The voltage is applied between the individual electrode 71 and common electrode 72 of the actuator 43 from the head control device 49 via the flexible cable 51. With this, a necessary portion of the piezoelectric element 70 is bent in the stack direction to change the volume of the necessary pressure chamber 82, thereby ejecting the ink from the nozzle 84.

Figure 8:
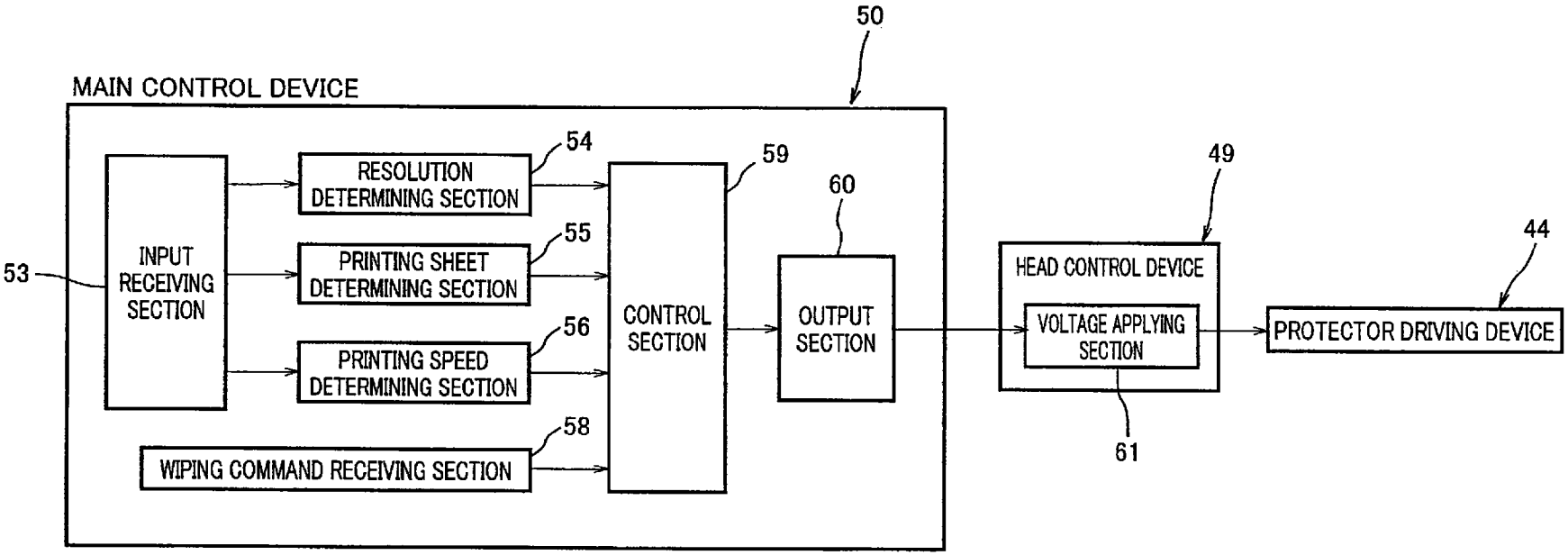
FIG. 8 is a block diagram for explaining control of a nozzle protector of the ink jet printer shown in FIG. 3.

As shown in FIG. 8, in the ink jet printer 3, the main control device 50 controls the operation of the protector driving device 44 via the head control device 49. The main control device 50 includes a CPU, a ROM which stores a program executed by the CPU and data used by the program, a RAM which temporarily stores the data when executing the program, a rewritable EEPROM, and an input/output interface.

To be specific, the main control device 50 includes an input receiving section 53, a resolution determining section 54, a printing sheet determining section 55, a printing speed determining section 56, a wiping command receiving section 58, a control section 59 and an output section 60. The input receiving section 53 receives a printing condition input by a user using the operation panel 10, a printing condition sent from an external personal computer (not shown), or a printing condition detected by some kind of detecting device (for example, an optical sensor which determines a type of printing sheet).

The resolution determining section 54 determines a printing resolution from the printing condition received by the input receiving section 53. The printing sheet determining section 55 determines a type of printing sheet (e.g., standard, inkjet, glossy, and transparency) from the printing condition received by the input receiving section 53. The printing speed determining section 56 determines a scanning speed and a sheet feeding speed of the image recording unit 16 from the printing condition received by the input receiving section 53. The wiping command receiving section 58 receives from a wiping command section (not shown) a wiping command for starting an operation of wiping the nozzle surface 42*a* with the wiper blade 21.

The control section 59 transmits via the output section 60 to the head control device 49 a control signal for reducing an amount to cause the nozzle protector 48 to project toward the printing sheet 30 as the printing conditions determined by the resolution determining section 54, the printing sheet determining section 55 and the printing speed determining section 56 are associated with a higher degree of contribution to an improvement of image quality. The head control device 49 includes a voltage applying section 61 that is a voltage generator for applying a voltage between the upper electrode 46 (see FIG. 5) and lower electrode 47 (see FIG. 5) of the protector driving device 44. That is, the voltage applying section 61 changes the voltage applied between the upper electrode 46 and the lower electrode 47, in accordance with the control signal supplied from the control section 59.

To be specific, the control section 59 transmits to the voltage applying section 61 a control signal for reducing an amount to cause the nozzle protector 48 to project from the nozzle surface 42*a* toward the printing sheet 30 as the printing resolution determined by the resolution determining section 54 is higher. Moreover, the control section 59 transmits to the voltage applying section 61*a* control signal for reducing an amount to cause the nozzle protector 48 to project from the nozzle surface 42*a* toward the printing sheet 30 as the printing sheet determined by the printing sheet determining section 55 has less flexibility. Further, the control section 59 transmits to the voltage applying section 61 a control signal for reducing an amount to cause the nozzle protector 48 to project from the nozzle surface 42*a* toward the printing sheet 30 as the printing speed determined by the printing speed determining section 56 is lower. In addition, the control section 59 transmits via the output section 60 to the voltage applying section 61*a* control signal for causing the nozzle protector 48 to retract until the lower surface of the nozzle protector 48 becomes flush with the nozzle surface 42*a*, that is, causing the nozzle protector 48 to move up to the non-projecting position, when the wiping command receiving section 58 receives the wiping command.

Figure 9:
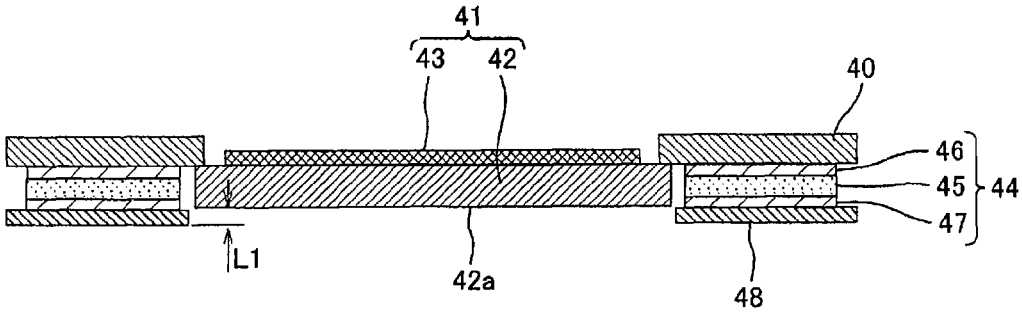
FIG. 9 illustrates a state of the nozzle protector shown in FIG. 5 in a standard sheet/low resolution mode.

Next, an up-down operation of the nozzle protector 48 will be explained. As shown in FIGS. 8 and 9, in a case where the user operates the operation panel 10 (see FIG. 1) to select a standard sheet as the printing sheet and a low resolution as the printing resolution, the input receiving section 53 receives such an input signal. Next, the resolution determining section 54, the printing sheet determining section 55 and the printing speed determining section 56 determine respective printing conditions based on this input signal. Specifically, by selecting the standard sheet as the printing sheet, the printing sheet determining section 55 determines that the flexibility of the printing sheet is high. Moreover, by selecting the low resolution as the printing resolution, the resolution determining section 54 determines that the printing resolution is low. Further, the printing speed determining section 56 determines that the printing speed is high. Next, the control section 59 controls such that the drive voltage applied by the voltage applying section 61 to the upper electrode 46 of the protector driving device 44 becomes zero. With this, the amount to cause the nozzle protector 48 to project from the nozzle surface 42*a* toward the printing sheet becomes maximum, i.e., L1 (for example, 0.25 mm≦L1≦0.35 mm).

Figure 10:
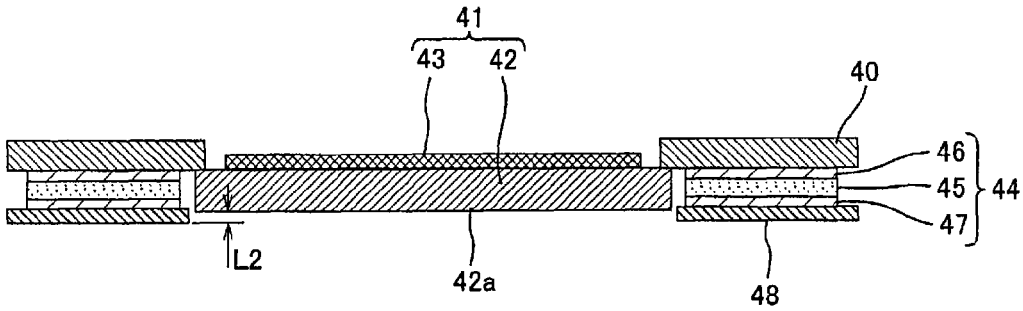
FIG. 10 illustrates a state of the nozzle protector shown in FIG. 5 in a special sheet/medium resolution mode.

As shown in FIGS. 8 and 10, in a case where the user operates the operation panel 10 (see FIG. 1) to select a special sheet as the printing sheet and a medium resolution as the printing resolution, the input receiving section 53 receives such an input signal. Next, the resolution determining section 54, the printing sheet determining section 55 and the printing speed determining section 56 determine respective printing conditions based on this input signal. Specifically, the resolution determining section 54 determines that the printing resolution is medium. Moreover, the printing sheet determining section 55 determines that the flexibility of the printing sheet is medium. Further, the printing speed determining section 56 determines that the printing speed is medium. Next, the control section 59 controls such that the drive voltage applied by the voltage applying section 61 to the upper electrode 46 of the protector driving device 44 becomes 1 kV. With this, the amount to cause the nozzle protector 48 to project from the nozzle surface 42*a* toward the printing sheet becomes L2 (for example, 0.15 mm≦L2≦0.25 mm) that is shorter than L1.

Figure 11:
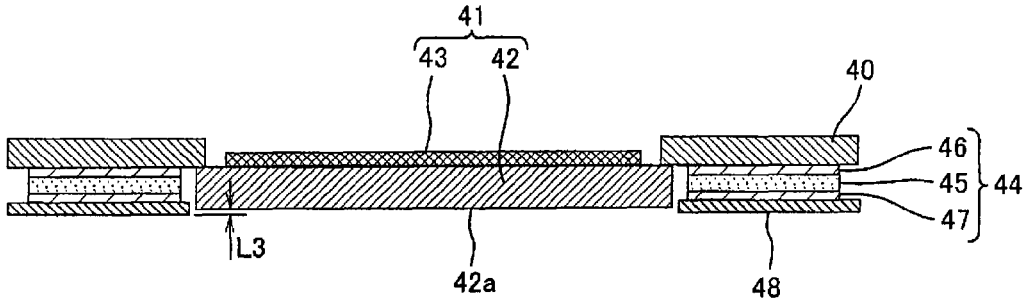
FIG. 11 illustrates a state of the nozzle protector shown in FIG. 5 in a glossy sheet/high resolution mode.

As shown in FIGS. 8 and 11, in a case where the user operates the operation panel 10 (see FIG. 1) to select a glossy sheet as the printing sheet and a high resolution as the printing resolution, the input receiving section 53 receives such an input signal. Next, the resolution determining section 54, the printing sheet determining section 55 and the printing speed determining section 56 determine respective printing conditions based on this input signal. Specifically, the resolution determining section 54 determines that the printing resolution is high. Moreover, the printing sheet determining section 55 determines that the flexibility of the printing sheet is low. Further, the printing speed determining section 56 determines that the printing speed is low. Next, the control section 59 controls such that the drive voltage applied by the voltage applying section 61 to the upper electrode 46 of the protector driving device 44 becomes 1.5 kV. With this, the amount to cause the nozzle protector 48 to project from the nozzle surface 42*a* toward the printing sheet becomes 13 (for example, 0.05 mm≦L3≦0.15 mm) that is shorter than L2.

Figure 12:
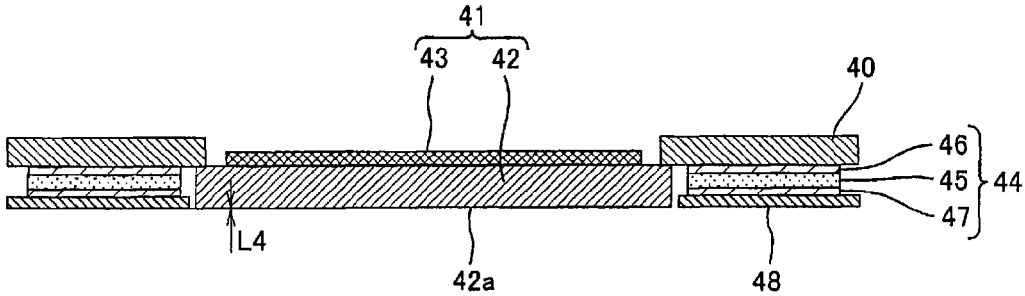
FIG. 12 illustrates a state of the nozzle protector shown in FIG. 5 during a wiping operation.

As shown in FIGS. 8 and 12, in a case where the wiping command receiving section 58 receives the wiping command from the wiping command section (not shown) which instructs the wiping operation periodically or in accordance with a user instruction, the control section 59 controls such that the drive voltage applied by the voltage applying section 61 to the upper electrode 46 of the protector driving device 44 becomes 2 kV. With this, the amount to cause the nozzle protector 48 to project from the nozzle surface 42*a* toward the printing sheet becomes 14 (for example, L4≦0 mm) that is shorter than L3.

In accordance with the above configuration, the position of the nozzle protector 48 can be changed easily by applying the voltage between the upper electrode 46 and the lower electrode 47 to contract the dielectric elastomer 45 in the normal direction of the nozzle surface 42*a*. Even the dielectric elastomer 45 having a small volume can deform greatly. Therefore, it is possible to significantly suppress the increase in size of the apparatus. Moreover, since the dielectric elastomer 45 precisely changes its deformation amount in accordance with the value of the voltage applied between the upper electrode 46 and the lower electrode 47, the position of the nozzle protector 48 integrally connected to the dielectric elastomer 45 can also be controlled precisely. Further, since the dielectric elastomer 45 is disposed around the entire periphery of the nozzle surface 42*a*, the nozzle protector 48 can be moved while maintaining its posture without using a guide.

Moreover, the nozzle protector 48 can continuously change its amount of projection toward the printing sheet 30 in the normal direction of the nozzle surface 42*a*. Therefore, it is possible to easily adjust a priority balance between a nozzle protecting function of causing the nozzle protector 48 to project so as not to cause the printing sheet 30 to contact the nozzle surface 42*a*, and an image quality improving function of decreasing the amount of projection of the nozzle protector 48 so as to cause the nozzle surface 42*a* and the printing sheet 30 to get close to each other.

Further, the voltage applied to the upper electrode 46 is set to zero in the frequently-used standard sheet/low resolution mode, while the voltage applied to the upper electrode 46 is set to maximum in the wiping operation which is much less frequently carried out than the printing. Therefore, it is possible to efficiently suppress the power consumption. Moreover, the printing sheet 30 becomes less likely to contact the nozzle surface 42*a* as the printing condition is associated with high image quality (high resolution, hard printing sheet, low printing speed). Therefore, it is possible to achieve a further improvement of the image quality by decreasing the amount of projection of the nozzle protector 48 to reduce a gap between the nozzle surface 42*a* and the printing sheet 30.

Further, since a main surface of the dielectric elastomer 45 that is a largest flat surface thereof is opposed to the nozzle protector 48, it is possible to stabilize displacement accuracy of the nozzle protector 48. Moreover, since the flexible cable 51 connected to the actuator 43 of the ink jet head 41 also functions as a wire member connected to the electrodes 46 and 47 formed on upper and lower surfaces, respectively, of the dielectric elastomer 45, it is possible to reduce the number of components.

Embodiment 2

Embodiment 2 is different from Embodiment 1 in that the gap between the nozzle surface 42*a* of the ink jet head 41 and the printing sheet 30 is adjustable. In Embodiment 2, same reference numbers are used for members corresponding to the members in Embodiment 1, and same explanations thereof are omitted.

Figure 13:
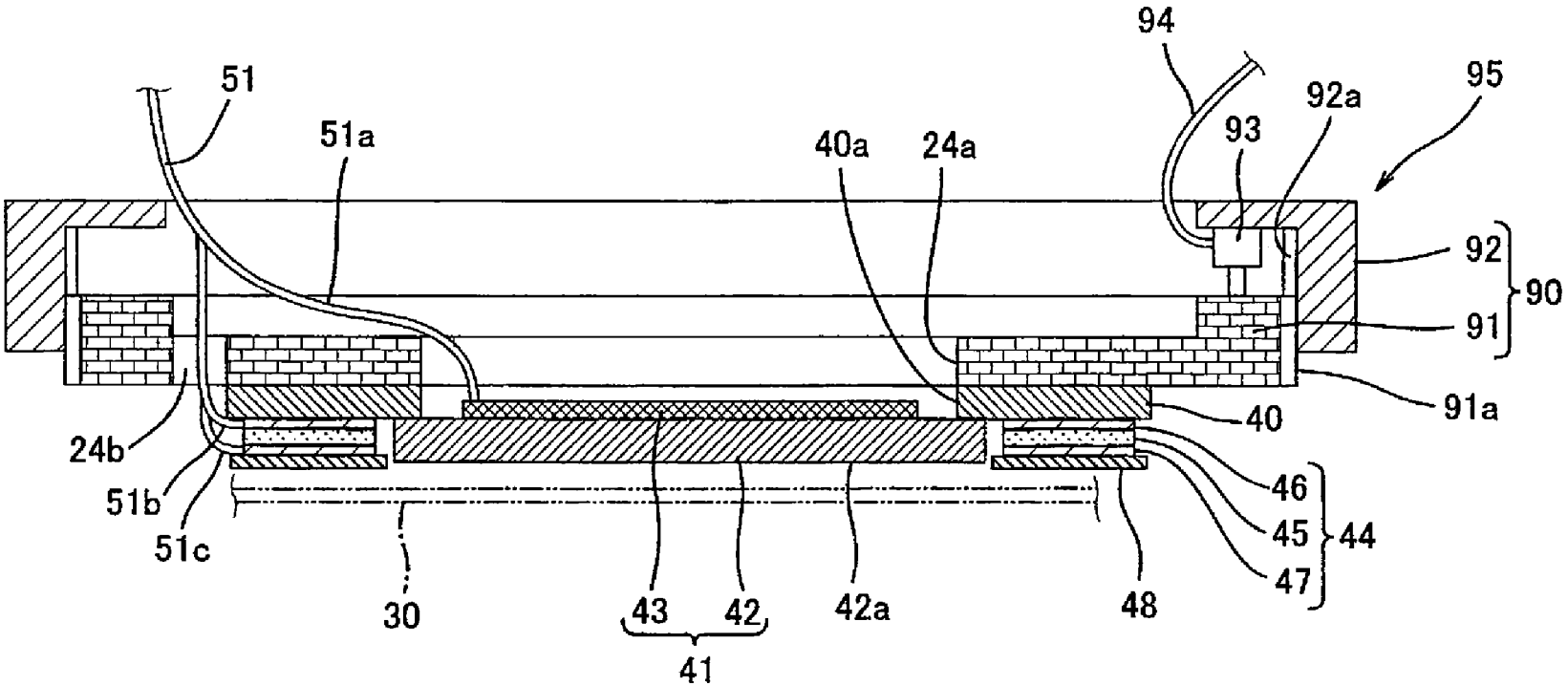
FIG. 13 is a cross-sectional view which shows an ink jet printer according to Embodiment 2 of the present invention, and corresponds to FIG. 5.

As shown in FIG. 13, a carriage 90 includes a first member 91 to which the ink jet head 41 is integrally attached, and a second member 92 supported by the guide rails 14 and 15 (see FIG. 2). A guide protruding portion 91*a* extending in the vertical direction is disposed on an outer side surface of the first member 91. A guide groove portion 92*a* extending in the vertical direction is disposed on an inner side surface of the second member 92 and at a position corresponding to the position of the guide protruding portion 91*a*. The second member 92 is fitted around the first member 91, and the guide protruding portion 91*a* is slidably guided by the guide groove portion 92*a*.

Moreover, a solenoid electric-powered actuator 93 is disposed between the first member 91 and the second member 92 to relatively displace the first member 91 in the vertical direction with respect to the second member 92. The electric-powered actuator 93 is supplied with electric power and controlled by a separate control device (not shown) via a wire 94. That is, a gap adjusting mechanism 95 is realized such that the second member 92 can be relatively displaced with respect to the first member 91 by the electric-powered actuator 93.

Figure 14:
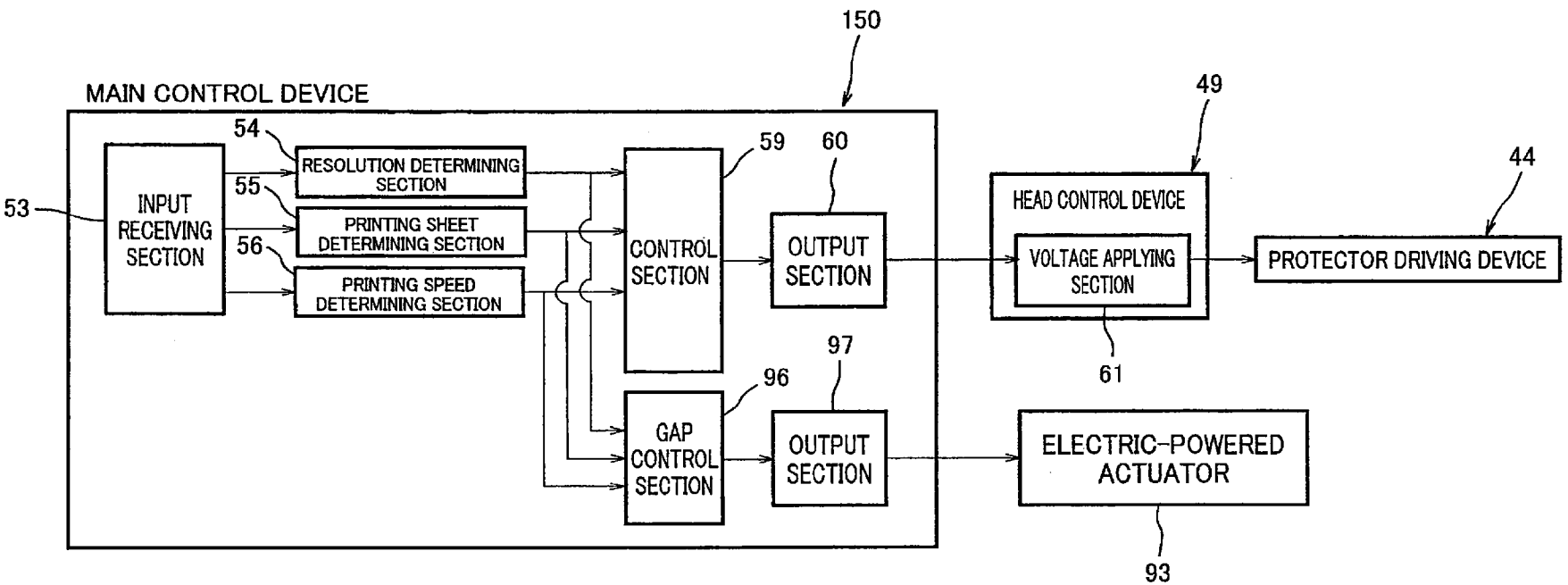
FIG. 14 is a block diagram of the ink jet printer shown in FIG. 13.

As shown in FIG. 14, a main control device 150 includes the input receiving section 53, the resolution determining section 54, the printing sheet determining section 55, the printing speed determining section 56, the control section 59, a gap control section 96, the output section 60 and an output section 97. The gap control section 96 controls the electric-powered actuator 93 via the output section 97 such that the gap between the nozzle surface 42*a* and the printing sheet 30 decreases as the printing conditions determined by the resolution determining section 54, the printing sheet determining section 55 and the printing speed determining section 56 are associated with a higher degree of contribution to the improvement of the image quality.

To be specific, the gap control section 96 controls the electric-powered actuator 93 such that the gap between the nozzle surface 42*a* and the printing sheet 30 decreases as the printing resolution determined by the resolution determining section 54 increases. Moreover, the gap control section 96 controls the electric-powered actuator 93 such that the gap between the nozzle surface 42*a* and the printing sheet 30 decreases as the flexibility of the printing sheet determined by the printing sheet determining section 55 decreases. Further, the gap control section 96 controls the electric-powered actuator 93 such that the gap between the nozzle surface 42*a* and the printing sheet 30 decreases as the printing speed determined by the printing speed determining section 56 decreases. Note that the positional control of the nozzle protector 48 is carried out in the same manner as in Embodiment 1.

In accordance with the above configuration, as the printing condition is associated with high image quality (high resolution, hard printing sheet, low printing speed), the gap between the nozzle surface 42*a* and the printing sheet 30 decreases while the amount of projection of the nozzle protector 48 decreases. Therefore, accuracy of ejecting ink onto the printing sheet 30 improves, thereby further improving the image quality.

Embodiment 3

Embodiment 3 is different from Embodiment 1 in that a nozzle protector 148 also functions as the lower electrode 47. In Embodiment 3, same reference numbers are used for members corresponding to the members in Embodiment 1, and same explanations thereof are omitted.

Figure 15:
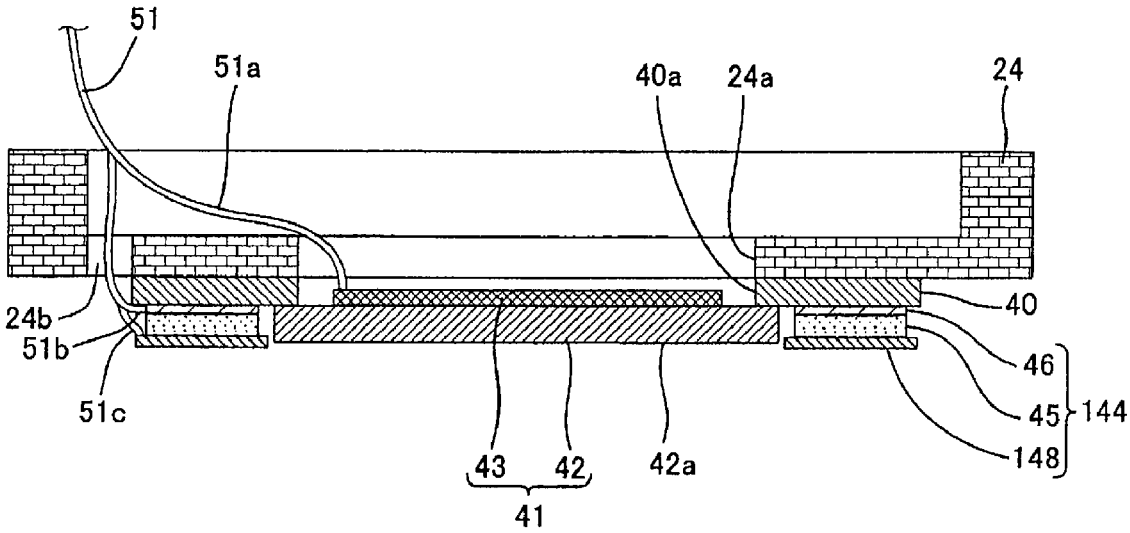
FIG. 15 is a cross-sectional view which shows an ink jet printer according to Embodiment 3 of the present invention, and corresponds to FIG. 5.

As shown in FIG. 15, a protector driving device 144, which is frame-shaped, is bonded to the lower surface of the reinforcing frame 40. The protector driving device 144 includes: the dielectric elastomer 45; the thin-film upper electrode 46 formed on the upper surface that is the main surface of the dielectric elastomer 45; and the nozzle protector 148 bonded to the lower surface that is the main surface of the dielectric elastomer 45. The nozzle protector 148 is made of an electrically-conductive material, such as metal, and also functions as the lower electrode of the protector driving device 144.

The actuator driving wire portion 51*a* of the flexible cable 51 is connected to the actuator 43 of the ink jet head 41. The dielectric elastomer driving wire portion 51*b* of the flexible cable 51 is connected to the upper electrode 46. The grounding wire portion 51*c* of the flexible cable 51 is connected to the nozzle protector 48.

In accordance with the above configuration, since the nozzle protector 48 made of the electrically-conductive material also functions as the lower electrode, it is possible to reduce the number of components. The present invention is applied to an ink jet printer in the above-described embodiments, however, the present invention may be applied to a recording apparatus which ejects liquid, such as electrically-conductive liquid, other than ink.

Although embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A liquid droplet ejecting apparatus which ejects liquid to a recording medium, comprising:

a liquid droplet ejecting head including a nozzle surface in which a plurality of nozzles are formed, the nozzles being configured to eject liquid droplets;

a dielectric elastomer disposed around the nozzle surface;

a pair of electrodes configured to sandwich the dielectric elastomer; and a nozzle protector formed integrally with the dielectric elastomer on a recording medium side of the dielectric elastomer, wherein the nozzle protector is attached to a surface of the dielectric elastomer, which is orthogonal to a direction in which the dielectric elastomer mainly contracts, wherein the nozzle protector is made of an electrically-conductive material, and wherein the nozzle protector functions as one of the pair of electrodes.

2. A liquid droplet ejecting apparatus which ejects liquid to a recording medium, comprising:

a liquid droplet ejecting head including a nozzle surface in which a plurality of nozzles are formed, the nozzles being configured to eject liquid droplets;

a dielectric elastomer disposed around the nozzle surface;

a pair of electrodes configured to sandwich the dielectric elastomer; and a nozzle protector formed integrally with the dielectric elastomer on a recording medium side of the dielectric elastomer, wherein the liquid droplet ejecting head includes: a passage unit having the nozzle surface, and a plurality of liquid chambers which are respectively disposed to communicate with the plurality of nozzles; and an actuator having a plurality of driving portions configured to independently change volumes of the plurality of liquid chambers;

a reinforcing frame is attached to a surface of the passage unit opposite the nozzle surface so as to project from the surface of the passage unit; and the nozzle protector is disposed such that the dielectric elastomer is sandwiched between the nozzle protector and a portion of the reinforcing frame which portion projects from the surface of the passage unit.

3. A liquid droplet ejecting apparatus which ejects liquid to a recording medium, comprising:

a liquid droplet ejecting head including a nozzle surface in which a plurality of nozzles are formed, the nozzles being configured to eject liquid droplets;

a dielectric elastomer disposed around the nozzle surface;

a pair of electrodes configured to sandwich the dielectric elastomer;

a nozzle protector formed integrally with the dielectric elastomer on a recording medium side of the dielectric elastomer;

a voltage generator configured to apply a voltage between the pair of electrodes; and a controller configured to control the voltage generator, wherein the controller is configured to control the voltage generator such that the nozzle protector moves between a projecting position in which the nozzle protector projects beyond the nozzle surface toward the recording medium and a non-projecting position at which the nozzle protector does not project beyond the nozzle surface toward the recording medium.

4. The liquid droplet ejecting apparatus according to claim 3, wherein:

in a state where a voltage is not applied between the pair of electrodes, the nozzle protector is located at the projecting position; and when the voltage is applied between the pair of electrodes, the dielectric elastomer contracts in a normal direction of the nozzle surface, and the nozzle protector moves to the non-projecting position.

5. The liquid droplet ejecting apparatus according to claim 4, further comprising a wiping device configured to carry out an operation of wiping the nozzle surface, wherein the controller controls the voltage generator such that the voltage is applied between the pair of electrodes during the operation of the wiping device.

6. The liquid droplet ejecting apparatus according to claim 5, wherein the voltage applied between the pair of electrodes during the operation of the wiping device is a voltage causing the nozzle protector to move to the non-projecting position.

7. A liquid droplet ejecting apparatus which ejects liquid to a recording medium, comprising:

a liquid droplet ejecting head including a nozzle surface in which a plurality of nozzles are formed, the nozzles being configured to eject liquid droplets;

a dielectric elastomer disposed around the nozzle surface;

a pair of electrodes configured to sandwich the dielectric elastomer;

a nozzle protector formed integrally with the dielectric elastomer on a recording medium side of the dielectric elastomer;

a voltage generator configured to apply a voltage between the pair of electrodes; and a controller configured to control the voltage generator, wherein the liquid droplet ejecting head is an ink jet head, and the recording medium is a printing sheet, and wherein the controller controls the voltage generator such that an amount of projection of the nozzle protector which projects beyond the nozzle surface toward the recording medium is changed in accordance with a printing condition.

8. The liquid droplet ejecting apparatus according to claim 7, wherein the controller controls the voltage generator such that the amount of projection of the nozzle protector toward the recording medium decreases as the printing condition increases a degree of contribution to an improvement of image quality.

9. The liquid droplet ejecting apparatus according to claim 8, wherein:

the printing condition includes printing resolution information; and the controller controls the voltage generator such that the amount of projection of the nozzle protector decreases as a printing resolution of the printing resolution information increases.

10. The liquid droplet ejecting apparatus according to claim 8, wherein:

the printing condition includes recording medium type information; and the controller controls the voltage generator such that the amount of projection of the nozzle protector decreases as flexibility of the recording medium of the recording medium type information decreases.

11. The liquid droplet ejecting apparatus according to claim 8, wherein:

the printing condition includes printing speed information; and the controller controls the voltage generator such that the amount of projection of the nozzle protector decreases as a printing speed of the printing speed information decreases.

12. The liquid droplet ejecting apparatus according to claim 7, further comprising:

a gap adjusting mechanism configured to displace the ink jet head in a normal direction of the nozzle surface; and a gap controller configured to control the gap adjusting mechanism such that a gap between the nozzle surface and the recording medium decreases as the printing condition increases a degree of contribution to an improvement of image quality.

13. A liquid droplet ejecting apparatus which ejects liquid to a recording medium, comprising:

a liquid droplet ejecting head including a nozzle surface in which a plurality of nozzles are formed, the nozzles being configured to eject liquid droplets;

a dielectric elastomer disposed around the nozzle surface;

a pair of electrodes configured to sandwich the dielectric elastomer;

a nozzle protector formed integrally with the dielectric elastomer on a recording medium side of the dielectric elastomer; and a flexible cable connected to the liquid droplet ejecting head, wherein:

the liquid droplet ejecting head includes: a passage unit having a plurality of liquid chambers which are respectively disposed to communicate with the plurality of nozzles; and an actuator having a plurality of driving portions configured to independently change volumes of the plurality of liquid chambers; and the flexible cable includes: a plurality of actuator driving wires connected to the plurality of driving portions of the actuator; and a dielectric elastomer driving wire connected to at least one of the pair of electrodes.

* * * * *